US011566496B2

(12) United States Patent
Rajabov et al.

(10) Patent No.: US 11,566,496 B2
(45) Date of Patent: Jan. 31, 2023

(54) GRAVEL PACK FILTRATION SYSTEM FOR DEHYDRATION OF GRAVEL SLURRIES

(71) Applicants: Vusal Rajabov, Houston, TX (US); Christophe Malbrel, Houston, TX (US)

(72) Inventors: Vusal Rajabov, Houston, TX (US); Christophe Malbrel, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 84 days.

(21) Appl. No.: 16/886,026

(22) Filed: May 28, 2020

(65) Prior Publication Data

US 2021/0372237 A1 Dec. 2, 2021

(51) Int. Cl.
*E21B 43/04* (2006.01)
*E21B 43/08* (2006.01)

(52) U.S. Cl.
CPC ..... *E21B 43/045* (2013.01); *E21B 43/082* (2013.01)

(58) Field of Classification Search
CPC ..... E21B 43/04; E21B 43/045; E21B 43/082
See application file for complete search history.

(56) References Cited

U.S. PATENT DOCUMENTS

| | | | | |
|---|---|---|---|---|
| 6,520,254 | B2 * | 2/2003 | Hurst | E21B 43/045 166/278 |
| 7,644,854 | B1 * | 1/2010 | Holmes | E21B 43/082 228/234.3 |
| 7,775,271 | B2 | 8/2010 | Johnson | |
| 7,784,543 | B2 | 8/2010 | Johnson | |
| 7,789,139 | B2 | 9/2010 | Johnson | |
| 7,793,714 | B2 | 9/2010 | Johnson | |
| 7,921,915 | B2 | 4/2011 | Richard et al. | |
| 8,056,627 | B2 | 11/2011 | Johnson et al. | |
| 8,132,624 | B2 | 3/2012 | Johnson et al. | |
| 8,151,875 | B2 | 4/2012 | Johnson | |
| 8,151,881 | B2 | 4/2012 | Johnson et al. | |
| 8,931,568 | B2 | 1/2015 | McNamee | |
| 9,962,632 | B2 | 5/2018 | Carrejo et al. | |
| 10,072,482 | B2 | 9/2018 | Hodge et al. | |
| 2006/0283604 | A1 | 12/2006 | Setterberg, Jr. et al. | |
| 2010/0059232 | A1 | 3/2010 | Langlais et al. | |
| 2015/0198016 | A1 | 7/2015 | Langlais | |
| 2017/0022789 | A1 | 1/2017 | Hodge et al. | |
| 2017/0342809 | A1 * | 11/2017 | Huh | E21B 43/08 |
| 2021/0324712 | A1 * | 10/2021 | Sladic | E21B 43/088 |

* cited by examiner

*Primary Examiner* — D. Andrews
(74) *Attorney, Agent, or Firm* — Cantor Colburn LLP

(57) ABSTRACT

A gravel packing apparatus includes a base pipe defining an interior fluid conduit, the base pipe having a production section configured to provide fluid communication between an exterior of the base pipe and an interior of the base pipe, the base pipe having a blank section. The apparatus also includes a screen surrounding the production section, the screen in fluid communication with an annular region of a borehole and configured to prevent particulate matter from passing therethrough, and a filtration assembly disposed proximate to the blank section, the filtration assembly including a fluid passage extending between an exterior of the blank section and an interior of the blank section.

18 Claims, 6 Drawing Sheets

GRAVEL PACK FILTRATION SYSTEM FOR DEHYDRATION OF GRAVEL SLURRIES

BACKGROUND

Various tools are utilized in the hydrocarbon exploration, drilling and completion industry to increase or maximize production efficiency. Sand control devices such as gravel packs are utilized to control the ingress of particulate contaminants into production fluid and to aid in stabilizing production formations.

Installing a gravel pack typically involves deploying a screen assembly including a base pipe and a screen into a borehole, and injecting a gravel slurry into an annular region around the screen assembly. Fluid from the gravel slurry is then drawn through the screen assembly and through fluid passages in the base pipe to dehydrate the slurry and set the gravel pack.

The screen assembly may include a connection arrangement at one or both ends for connecting the screen assembly to another screen assembly or other component. The connection arrangement typically includes a blank section of the base pipe at which there are no fluid passages. As such, an additional feature such as a wire wrap is typically installed with the screen assembly so that gravel slurry around the blank section can sufficiently dehydrate and a gravel pack can be evenly set along the screen assembly.

BRIEF DESCRIPTION OF THE INVENTION

An embodiment of a gravel packing apparatus includes a base pipe defining an interior fluid conduit, the base pipe having a production section configured to provide fluid communication between an exterior of the base pipe and an interior of the base pipe, the base pipe having a blank section. The apparatus also includes a screen surrounding the production section, the screen in fluid communication with an annular region of a borehole and configured to prevent particulate matter from passing therethrough, and a filtration assembly disposed proximate to the blank section, the filtration assembly including a fluid passage extending between an exterior of the blank section and an interior of the blank section.

An embodiment of a method of controlling particulates in downhole fluid includes deploying a gravel packing apparatus in a borehole in a subterranean region, the gravel packing apparatus including a base pipe defining an interior fluid conduit, the base pipe having a production section configured to provide fluid communication between an exterior of the base pipe and an interior of the base pipe, the base pipe having a blank section. The gravel packing apparatus includes a screen surrounding the production section, the screen in fluid communication with an annular region of a borehole and configured to prevent particulate matter from passing therethrough. The method also includes injecting a gravel slurry into the borehole and advancing the gravel slurry to an annular region of the borehole surrounding the gravel packing apparatus, dehydrating the gravel slurry to form a gravel pack, where the dehydrating includes removing fluid from the gravel slurry through the screen, and flowing fluid from a portion of the gravel slurry surrounding the blank section via a filtration assembly disposed proximate to the blank section. The filtration assembly includes a fluid passage extending between an exterior of the blank section and an interior of the blank section.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Systems, apparatuses and methods for controlling sand and other particulates in a downhole environment are described herein. An embodiment of a filtration assembly is configured to be installed proximate to a connection feature of a screen assembly such as a gravel packing tool. The filtration assembly, in one embodiment, is attached to or incorporated in a blank section of a base pipe and establishes a fluid path through the blank section. The fluid path allows for fluid in a gravel slurry to migrate from an annular region around the connection feature to a fluid conduit in the base pipe.

In one embodiment, the filtration assembly includes a porous medium, such as a wire mesh, perforated plate or disc, or any other medium that allows fluid to flow therethrough. For example, the porous medium can include a beaded matrix, also referred to as a bead screen. The bead screen or other porous medium may be directly attached to the base pipe (e.g., via adhesion or welding), or incorporated into a filtration device having a support structure that holds the porous medium and includes an attachment mechanism such as bolt holes or other features to accommodate mechanical fasteners.

Embodiments described herein present a number of advantages. The filtration assemblies and screen assemblies described herein provide cost-effective means to ensure a uniform and effective gravel pack. For example, the filtration assembly provides a way for gravel slurry around the blank section(s) of a base pipe and the connection feature(s) to dehydrate and result in an evenly distributed and tight gravel pack in the annular region around the blank section.

Furthermore, the filtration assembly can be integrated with a base pipe to provide for the ability to dehydrate a slurry without taking up significant space in a screen assembly. This eliminates the need for bulky components such as leak-off tubes, so that space is freed to allow incorporation of fiber optic cables or other desired components. In addition, the filtration assembly can be installed during manufacture and assembly of a screen assembly, so that additional installation is not needed at a rig site, which reduces overall screen make up time.

Figure 1:
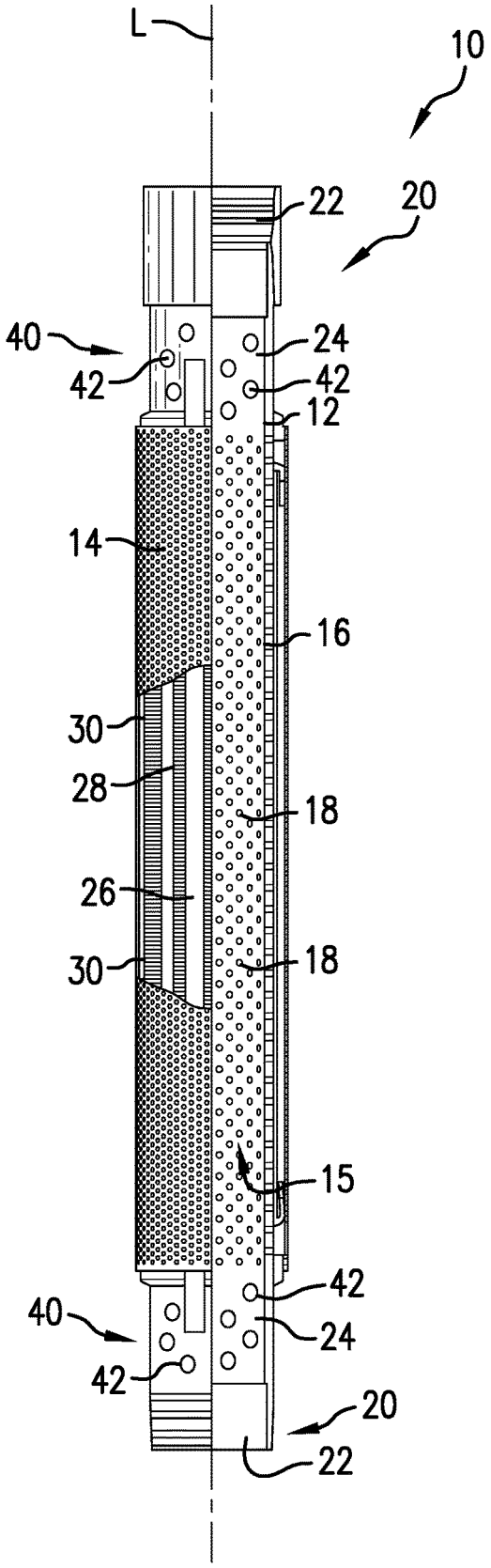
FIG. 1 depicts an embodiment of a gravel packing apparatus or gravel packing tool including a base pipe and a screen, and a filtration assembly disposed proximate to a blank section of the base pipe.

FIG. 1 depicts an embodiment of a screen assembly 10 configured to be deployed in a borehole as part of a subterranean system and operation. The screen assembly 10, in one embodiment, is configured to be deployed as part of a gravel pack system. The screen assembly 10 includes a base pipe 12 and a screen 14 mounted on the base pipe 12.

The base pipe 12 is axially elongated, i.e., extends along a longitudinal axis L and defines an inner fluid conduit 15 that can be connected to a borehole string or otherwise connected to a production conduit (e.g., production tubing and/or pipe segments). The base pipe 12 includes a first section 16 (also referred to as a production section 16) that is at least partially surrounded by the screen 14. The production section 16 includes a plurality of holes 18 or other fluid passages that provide fluid paths for fluid entering through the screen 14 to flow through the base pipe 12 and into the inner fluid conduit 15. The production section 16 is not so limited, and can have any type or number of holes, channels, ports or other features for permitting fluid to flow therethrough.

The screen 14 is configured to allow fluid flow therethrough but exclude particulate matter such as produced sand. The screen 14 may be, for example, a cylindrical member made of aluminum, steel or other suitable material and include a woven, perforated or any other configuration sufficient to exclude undesired sand or other particulate matter. The screen 14 is not limited to any particular type, and may include any suitable filtration media and configuration that screens out particulate material. Examples include a screen jacket structure, a wire wrap structure, a bead screen structure, a shape memory foam structure and others.

The screen assembly 10 also includes one or more joint sections 20 at one or more ends of the base pipe 12 to permit connection between the screen assembly 10 and other downhole components. Examples of other downhole components include pipe segments, coiled tubing, production strings, injection strings, measurement devices (e.g., sensor subs, logging while drilling tools and/or measurement while drilling tools) and others.

Each joint section 20 includes a connection arrangement 22 (also referred to simply as a connection) that is attached to or integrated into a respective end of the base pipe 12. The connection 22 may include a threaded component (e.g., box or pin) or any other mechanism for connecting adjacent components.

The base pipe 12 also includes a blank section 24 at one or more ends. The blank section 24 is a section of the base pipe 12 that extends from the production section 16 and terminates at or near the connection 22. Blank sections are typically provided at the end(s) (or at any other suitable location or locations) of screen assemblies, drill pipes, subs and other parts of a borehole string, so that they can be safely handled at the surface and deployed in a borehole without damaging components. For example, the blank section 24 allows the base pipe 12 to be handled without damaging or interfering with the screen 14 and other components of the screen assembly 10. The embodiment of FIG. 1 shows a blank section 24 at both ends; however, the base pipe 12 may have a blank section 24 at only one end.

In one embodiment, the screen assembly 10 is configured as a secondary path or multi-path gravel packing tool. In this embodiment, the screen assembly 10 includes one or more slurry conduits through which a gravel slurry can be pumped in the event that the slurry cannot be completely deployed via a borehole annulus. For example, the screen assembly of FIG. 1 includes at least one slurry tube 26 that extends longitudinally outside of the base pipe 12 and inside the screen 16. The slurry tube 26 provides one or more additional flow paths for transport of slurry over a selected completion interval or zone, in the event of an annular restriction caused by, e.g., borehole collapse, early proppant bridging or shale swelling.

The screen assembly 10 may include additional slurry conduits. For example, the screen assembly 10 includes one or more packing tubes 28 through which a gravel slurry can be injected. Each packing tube 28 includes an array of nozzles 30 to facilitate even placement of gravel, particularly for long intervals.

The screen assembly 10 includes or is connected to a dehydration or filtration assembly 40 configured to provide a flow path for fluid in a gravel slurry surrounding the blank section 24 (and/or the connection 22) to flow into the base pipe 12. The filtration assembly 40 includes one or more fluid passages 42 that extend through a wall of the blank section 24. The one or more fluid passages 42 may be formed integral with the base pipe 12 (e.g., as holes through the blank section wall) or as inserts or structures that can be attached to the blank section 24 and/or other location of the base pipe 12.

The filtration assembly 40 is disposed on a surface of the blank section 24, at or within a wall of the blank section 24, or is otherwise disposed proximate to the blank section 24. As referred to herein, a location "proximate" to the blank section refers to a location at the blank section 24 or at a location relative to the blank section 24 such that fluid flowing through the filtration assembly is directed from an annular region around the blank section 24 to an interior of the base pipe 12.

In use, a gravel slurry is injected into a borehole and deployed into an annular space or annular region between the screen assembly 10 and a borehole wall (or casing). The slurry is then dehydrated by leaking fluid from the slurry into the base pipe 12. Liquid in the slurry is drawn into the base pipe 12 through the screen 14 to dehydrate the slurry and consolidate the gravel around the screen assembly 10.

During dehydration, fluid is able to readily seep through the screen 14 and the holes 18 in the production section 16 of the base pipe 12. The filtration assembly 40 provides an additional flow path from an annular region of a borehole that surrounds the connections 22 and/or the blank sections 24, to an interior of the base pipe 12. In this way, the filtration assembly 40 allows for a gravel slurry to be evenly dehydrated, so that a consistent gravel pack can be established along the entire length of the screen assembly 10 and the connections 22.

As described herein, an annular region that "surrounds" or is "surrounding" a component refers to a region of a borehole that has the same or similar depth as the component, or that extends along a depth range that is the same as or similar to a depth range of the component. "Depth" refers to a distance along a path of a borehole from a surface location to a location in the borehole. In some instances, sections of a borehole may be deviated or horizontal, and accordingly a location at smaller depth can have the same vertical depth or even a greater vertical depth than a location at a greater depth.

Figure 2:
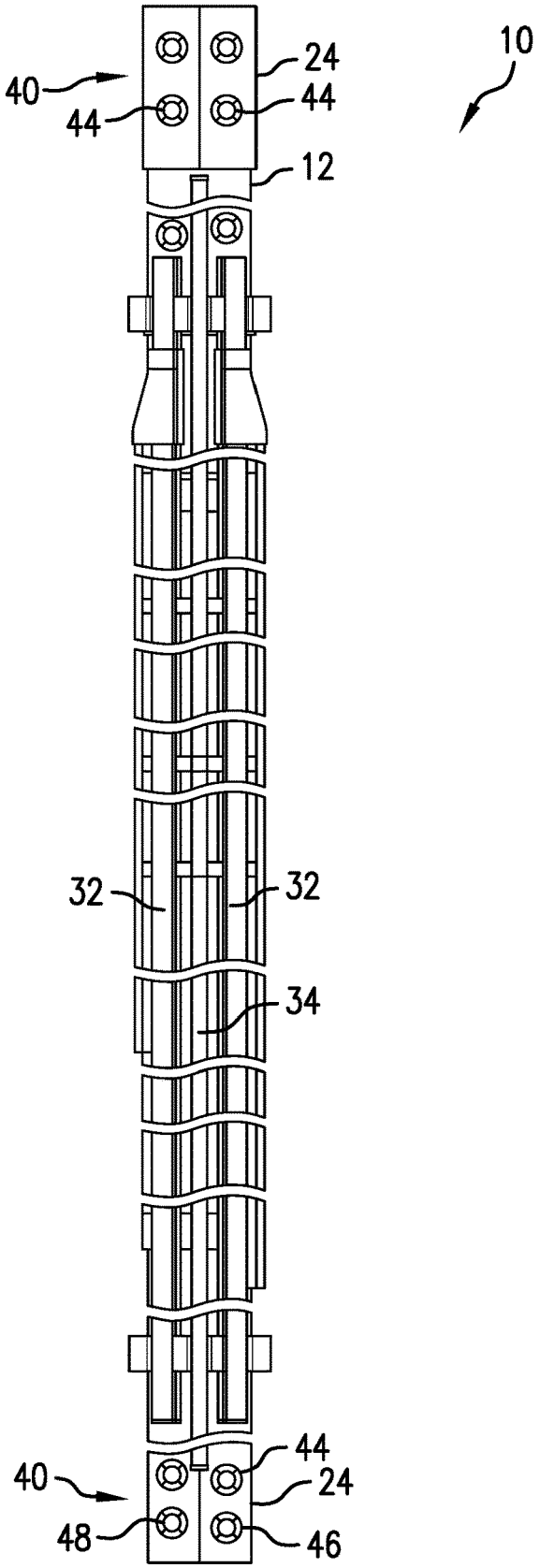
FIG. 2 depicts an embodiment of a gravel packing tool including a base pipe and a screen, and a filtration assembly disposed proximate to a blank section of the base pipe.
Figure 3:
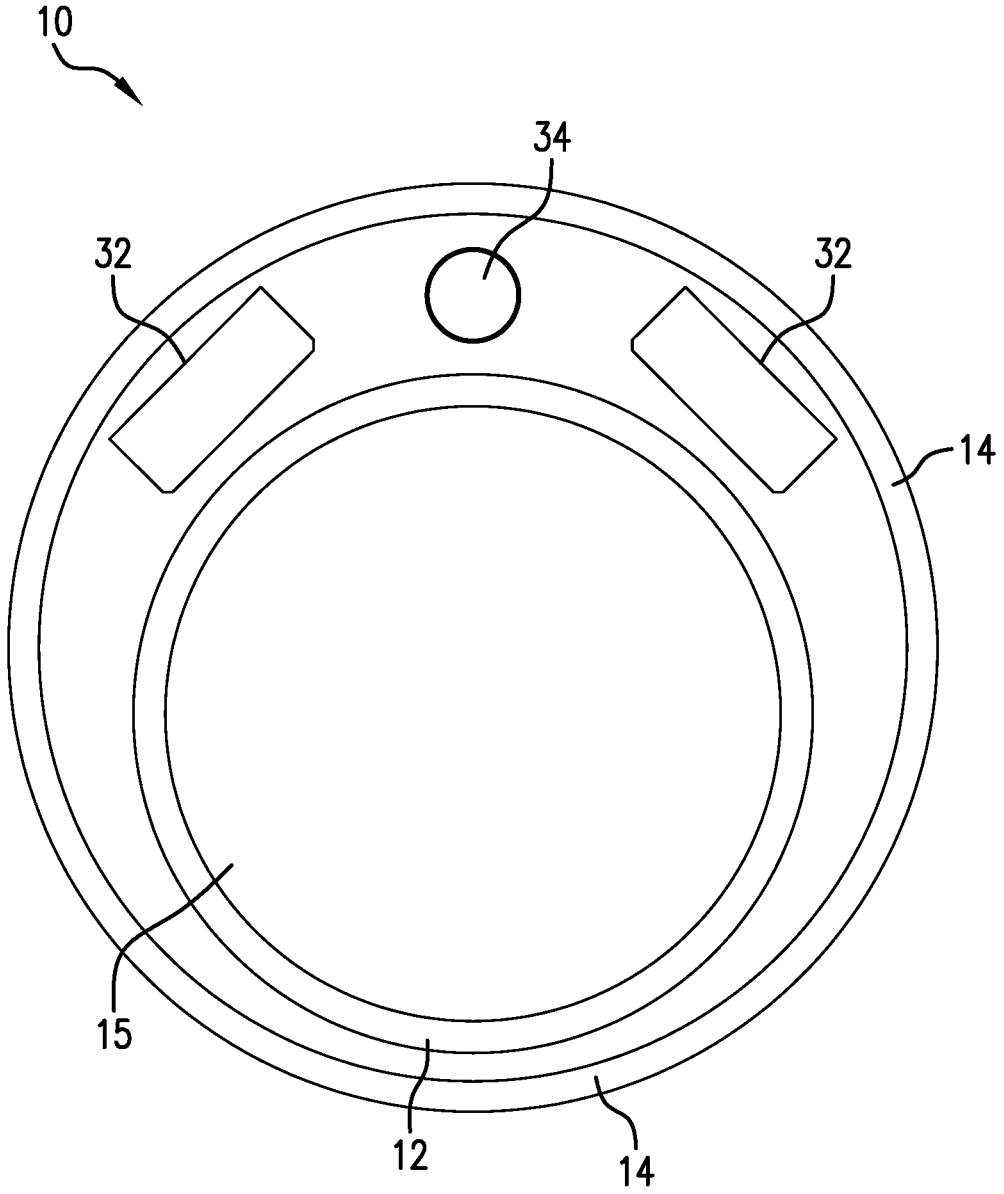
FIG. 3 is a cross-sectional view of the gravel packing tool of FIG. 2.
Figure 4:
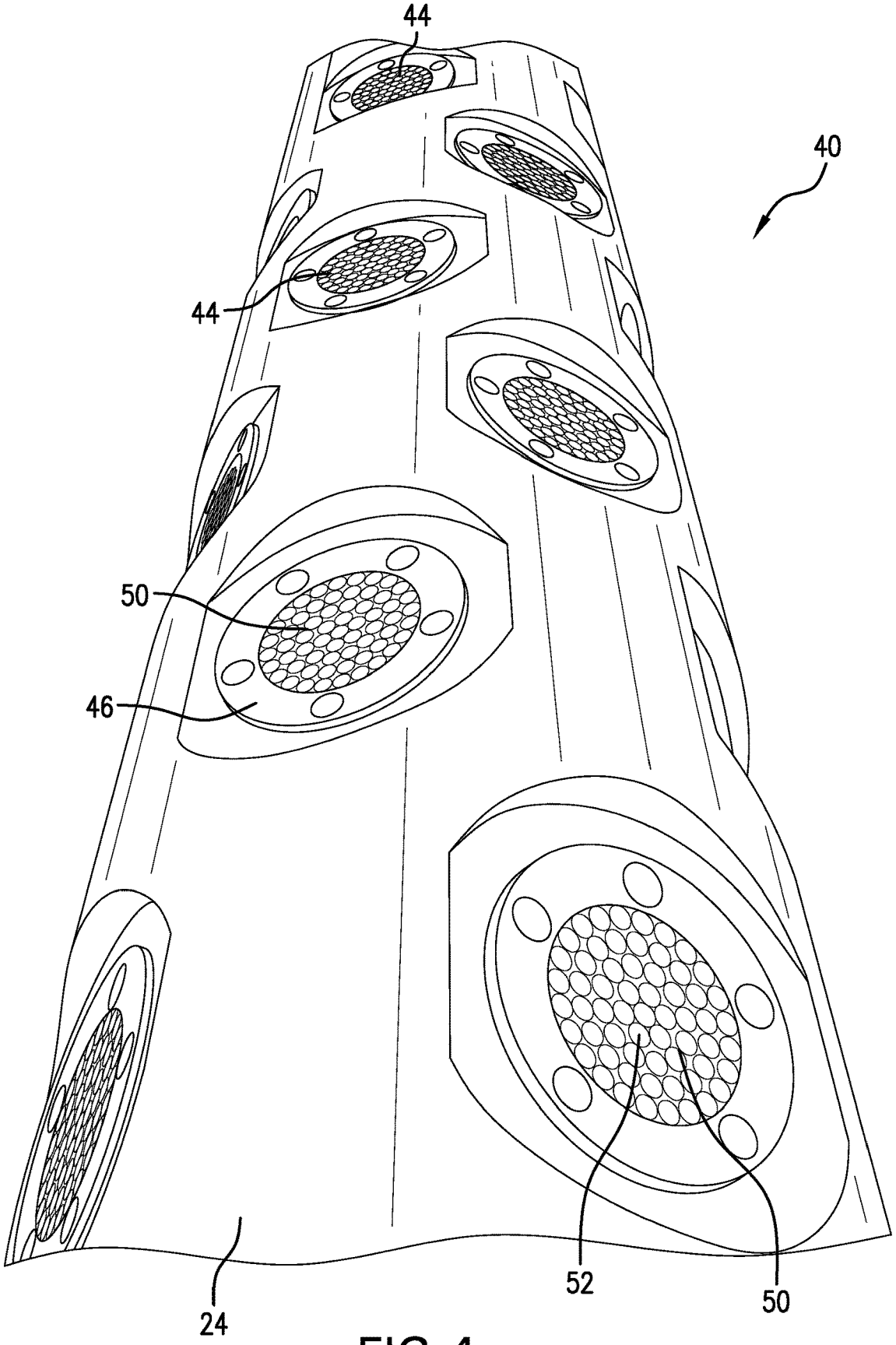
FIG. 4 depicts an embodiment of a filtration assembly including a plurality of filtration devices disposed at a blank section of a base pipe.

FIGS. 2-4 depict examples of the screen assembly 10, in which the filtration assembly 40 includes one or more individual filtration devices 44, each of which includes a support structure or housing 46 that supports a porous medium 48.

It is noted that the system 10 and the filtration assembly 40 are not limited to the specific fluid passages and porous media described herein. In the following examples, the porous medium 48 is configured as a flat screen structure such as a woven wire screen or a bead screen. The porous medium 48 can have any suitable size, shape or configuration. Other examples of the porous medium 48 include perforated plates, foam structures, various types of woven screens and others.

FIGS. 2 and 3 depict an example of the screen assembly 10, which includes one or more filtration devices 44 configured as circular, disc shaped inserts. FIG. 2 shows the screen assembly 10 with the screen 14 removed, and FIG. 3 is a cross-section of the screen assembly of FIG. 2, with the screen 14 included.

In this example, each filtration device 44 includes a ring-shaped housing 46 on which a porous medium such as a wire mesh or wire screen is attached. The housing 46 of each filtration device 44 is removably attached to the wall of the blank section 24 via attachment mechanisms such as screws or bolts.

Also in this example, the screen assembly includes two slurry conduits configured as rectangular shunt tubes 32. Each shunt tube 32 extends between the ends of the base pipe 12, and can be connected to adjacent components to provide an alternate slurry path in the event that an annular region is blocked or restricted. The screen assembly may include other components, such as a communication conduit 34 through which optical fibers, electrical conductors, cables, hydraulic control lines and other elongated components can be installed.

In one embodiment, the screen assembly 10 incorporates one or more beaded matrices, also referred to as "bead screens." Each bead screen includes a two dimensional or three dimensional array of individual beads. Interstitial spaces between the beads provide at least part of a flow path for fluid from a surrounding annular space to migrate through the blank section 24 and into the base pipe 12. A bead screen may include a single two-dimensional array of beads, or include multiple layers of beads to form a three dimensional volume. Although the bead screens are shown as flat in the following example, the bead screens are not so limited, as arrays of bead screens can be rounded, cylindrical or have any suitable shape.

The beads themselves can be formed of many materials such as ceramic, glass, metal, etc. without departing from the scope of the disclosure. The beads may then be joined together (such as by sintering, for example) to form a mass (a matrix) such that interstitial spaces are formed therebetween to provide permeability. In some embodiments, the beads are coated with another material for various chemical and/or mechanical resistance reasons. For example, a nickel coating material can be applied to the matrix for wear resistance and avoidance of clogging of the matrix. In another embodiment, the beads are coated with a highly hydrophobic coating that works to exclude water in fluids passing through the device 10.

Referring to FIG. 4, for example, the filtration assembly 40 includes a plurality of individual filtration devices 44, each of which includes a housing 46 configured as a support ring, and at least one beaded matrix or bead screen 50. The bead screen 50 forms at least part of the porous medium 48, i.e., the porous medium may exclusively be a bead screen, or the porous medium may be a bead screen in combination with a wire mesh or other porous component. The individual beads 52 in each bead screen 50 may be rounded though not necessarily spherical. A rounded geometry is useful primarily in avoiding clogging of the matrix since there are few edges upon which debris can gain purchase. The beads 50 may take any suitable shape (e.g., ovular, cylindrical, etc.), and are thus not limited to rounded shapes.

In one embodiment, the filtration device 44 is configured so that the filtration device 44 is flush with an exterior surface of the blank section, or at least does not extend radially (e.g., perpendicular to the axis L) beyond the exterior surface. In other words, the filtration device 44, when installed in a receptacle of the base pipe wall, extends through the pipe wall, but is sized so that the filtration device 44 does not extend radially beyond an exterior surface of the pipe wall. An example of this configuration is shown in FIG. 4. Flush and/or recessed filtration devices at the blank section allows for pipe handling (e.g., while adding a pipe section to a borehole string), in that the filtration devices do not interfere with handling equipment and/or operators.

Figure 5:
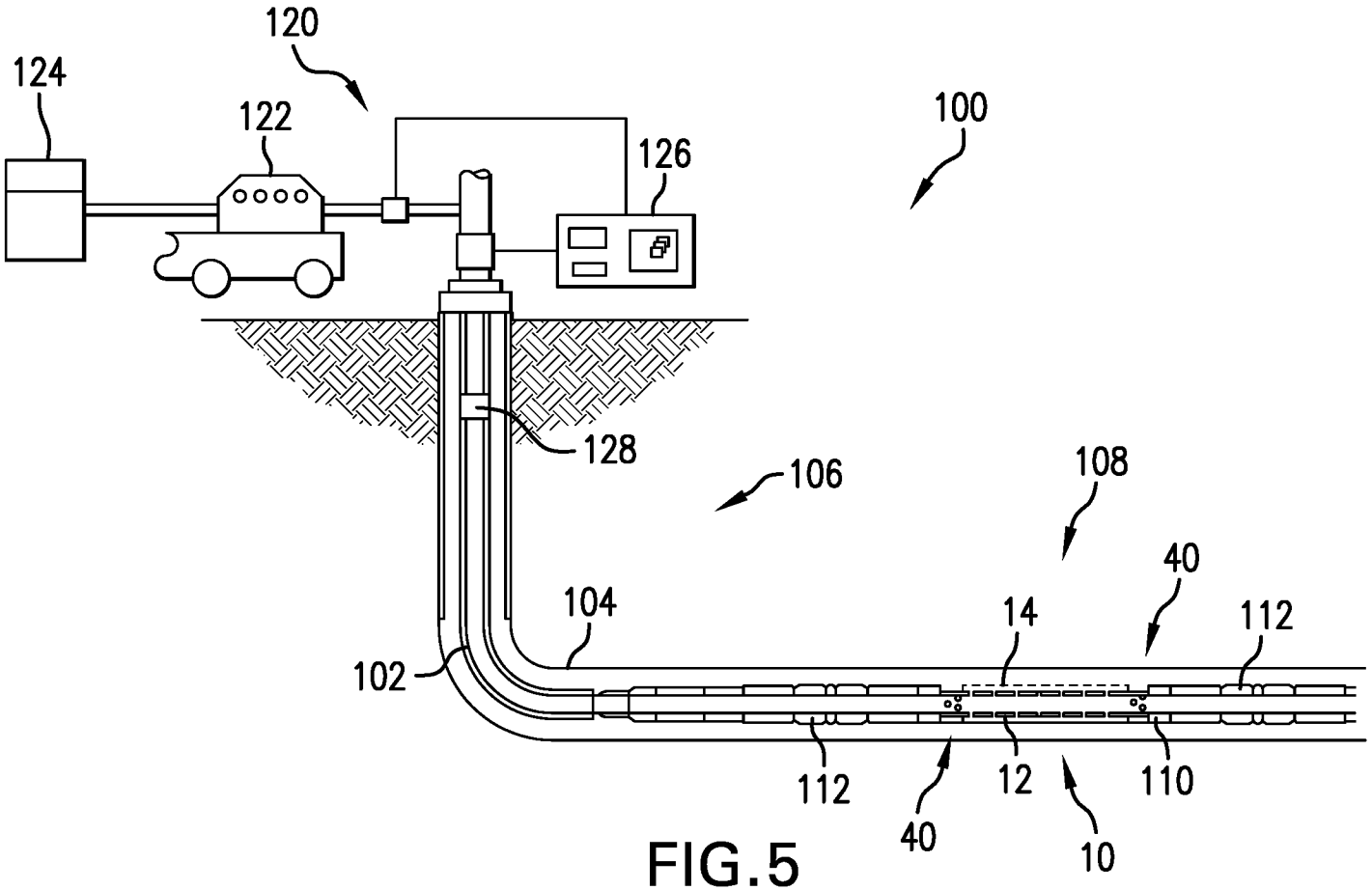
FIG. 5 depicts an embodiment of a downhole completion and/or production system including a gravel packing tool.

FIG. 5 depicts an example of a system 100 configured to perform a subterranean operation, in which the screen assembly 10 can be incorporated. The system 100 in this example is a resource or energy production system 10 that includes a borehole string 102 disposed in a borehole 104 extending into a subterranean region or a resource bearing formation, such as an earth formation 106.

The borehole string 102 includes a completion string having a production assembly 108 that includes the screen assembly 10, and a flow control assembly including a flow control device 110 such as an inflow control device (ICD). The production assembly 108 may include additional components, such as one or more packer assemblies 112 configured to isolate components and/or zones in the borehole 102. For example, multiple packer assemblies 112 can be used to establish production zones around the borehole 104. The borehole string 102 and/or the production assembly 108 may include other components to facilitate production, such as an electric submersible pump (ESP), other artificial lift devices, a fracture or "frac" sleeve device and/or a perforation assembly.

The system 100 also includes surface equipment 120 such as a drill rig, rotary table, top drive, blowout preventer and/or others to facilitate deploying the borehole string 102, operating various downhole components, monitoring downhole conditions and controlling fluid circulation through the borehole 104 and the borehole string 102. The surface equipment 120 may include a fluid control system 122 including one or more pumps in fluid communication with a fluid tank 124 or other fluid source. The fluid control system 122 facilitates injection of fluids, such as gravel slurries, proppant, drilling fluid (e.g., drilling mud), stimulation fluid (e.g., a hydraulic fracturing fluid) and others.

One or more components of the borehole string 102 may be configured to communicate with a surface location (e.g., the surface equipment 120). The communication may be wired or wireless. A processing device such as a surface processing unit 126 and/or a subsurface processing unit 128 disposed in the borehole 104 and connected to one or more downhole components. The processing device may be configured to perform functions such as controlling downhole components, transmitting and receiving data, processing measurement data and/or monitoring operations. The processing device may also control aspects of fluid circulation, such as fluid pressure and/or flow rate in the borehole string 102.

Figure 6:
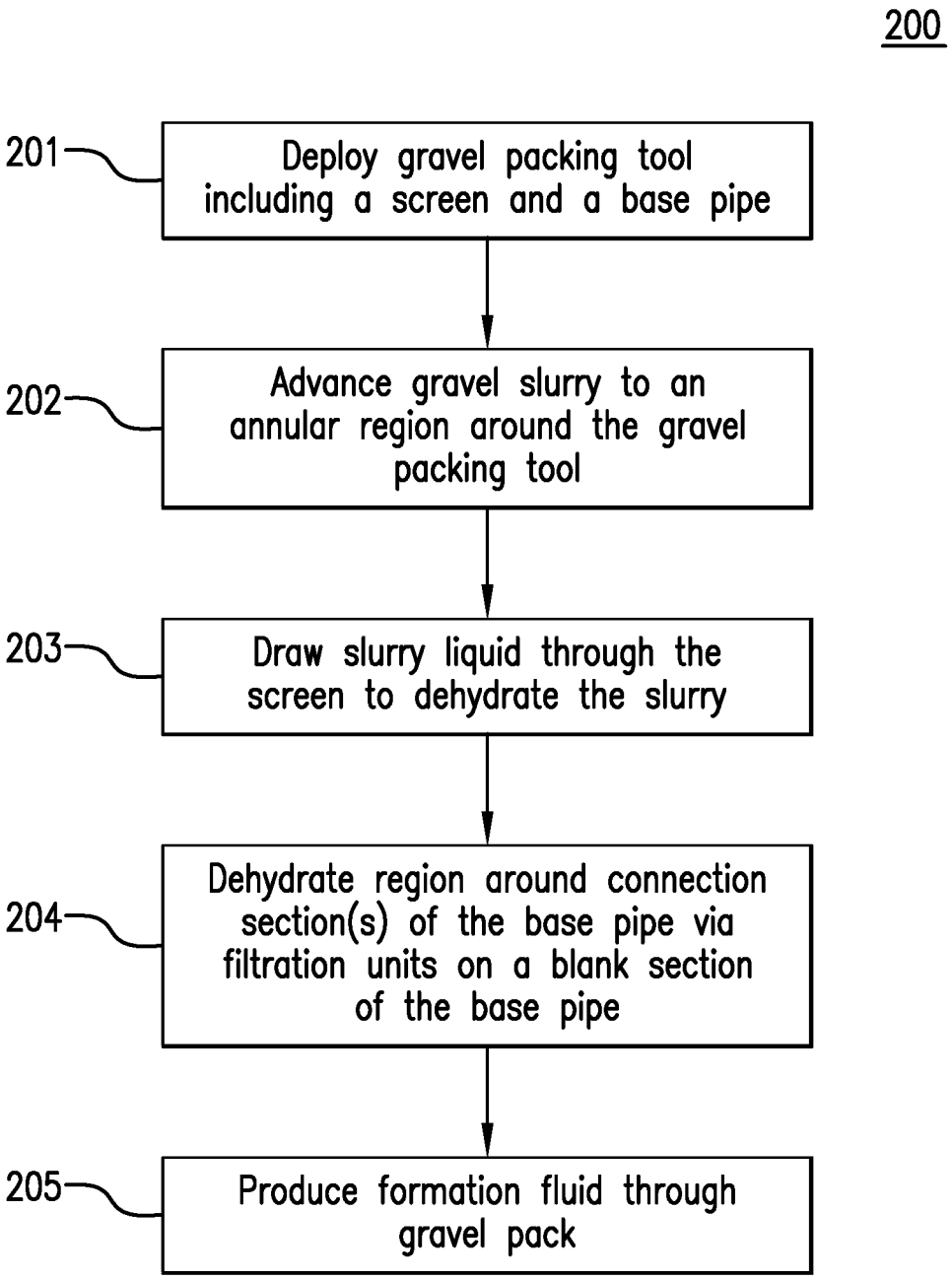
FIG. 6 is a flow diagram depicting a method of forming a gravel pack in a borehole and/or performing aspects of a production operation.

FIG. 6 illustrates a method 200 of controlling particulates such as produced sand in a borehole. The method is performed in conjunction with a gravel packing tool such as the screen assembly 10. The method 200 includes one or more stages 201-205. Although the method 200 is described in conjunction with the screen assembly 10, the method can be utilized in conjunction with any suitable gravel packing device or system.

In the first stage 201, the screen assembly 10, including a base pipe 12, a screen 14 and a filtration assembly 40, is deployed to a downhole location, via for example a borehole string 102 or wireline. In the second stage 202, a gravel slurry is pumped or otherwise advanced through the borehole string 102 to an annular region of the borehole 104 surrounding at least the screen assembly 10. The gravel slurry includes a gravel material such as natural sand or synthetic materials having grains sized to exclude produced sand or other undesired particulates.

In the third stage 203, the gravel slurry is dehydrated by drawing liquid through the screen 14 and a production section 16 of the base pipe 12. Gravel particles collect and consolidate in the annular region to form a gravel pack in the annular region and/or around the screen 14.

In the fourth stage 204, an annular region surrounding at least blank sections 24 of the base pipe 12 is dehydrated by drawing liquid through the filtration assembly. In this way, the annular regions surrounding both the screen 14 and the blank sections 24 are evenly dehydrated to form a tight, consistent gravel pack along an entirety of the screen assembly 10. In the fifth stage 205, formation fluid is produced by flowing the formation fluid through the gravel pack and the screen 14, and through the borehole string 102.

Embodiments described herein provide an effective means to dehydrate gravel slurry around (i.e., surrounding at a given borehole location or depth) blank pipe sections and connections between downhole components. In prior art approaches, because blank sections of gravel pack base pipes do not have any fluid passages therethrough, fluid in the gravel slurry around the blank section is typically redirected into the base pipe by installing a component around the connection to provide a flow path from the area around the connection to the base pipe. For example, slotted rectangular or round wire wrap tubes can be installed on the blank sections of the screens at the rig side.

These tubes are bulky and take up a lot of space on the screen assembly, which makes it difficult to integrate additional components, such as fiber optic control lines, on the screen assembly. Due to space limitations, installing wire wrap leak-off tubes (or other components) at connections can prevent the inclusion of such components (e.g., in 5.5" screens).

Embodiments described herein address the above challenges via a filtration assembly disposed at a blank section of a base pipe, which includes fluid passages and/or porous media that provides effective dehydration of gravel slurry at connections. The embodiments provide for effective dehydration without the need for leak-off tubes or other flow control components.

Set forth below are some embodiments of the foregoing disclosure:

Embodiment 1: A gravel packing apparatus comprising: a base pipe defining an interior fluid conduit, the base pipe having a production section configured to provide fluid communication between an exterior of the base pipe and an interior of the base pipe, the base pipe having a blank section; a screen surrounding the production section, the screen in fluid communication with an annular region of a borehole and configured to prevent particulate matter from passing therethrough; and a filtration assembly disposed proximate to the blank section, the filtration assembly including a fluid passage extending between an exterior of the blank section and an interior of the blank section.

Embodiment 2: The apparatus of any prior embodiment, wherein the blank section extends to an end of the base pipe, the end of the base pipe including a connection arrangement configured to connect the gravel packing apparatus to another downhole component.

Embodiment 3: The apparatus of any prior embodiment, wherein the gravel packing apparatus is configured to be deployed in a borehole and form part of a gravel pack, the gravel pack formed by injecting a gravel slurry into the borehole and advancing the gravel slurry to the annular region of the borehole surrounding the gravel packing apparatus, and dehydrating the gravel slurry by removing fluid from the gravel slurry and flowing the fluid through the screen and the production section to an interior of the base pipe.

Embodiment 4: The apparatus of any prior embodiment, wherein the filtration assembly is configured to dehydrate a portion of the gravel slurry surrounding the blank section.

Embodiment 5: The apparatus of any prior embodiment, further comprising at least one fluid conduit extending axially along the base pipe, the at least one fluid conduit configured to transport a gravel slurry.

Embodiment 6: The apparatus of any prior embodiment, wherein the at least one fluid conduit is configured to provide a fluid path for the gravel slurry in response to a restriction in the annular region that impedes a flow of a gravel slurry.

Embodiment 7: The apparatus of any prior embodiment, wherein the blank section of the base pipe has a pipe wall, and the filtration device extends through the pipe wall and is configured so that the filtration device does not extend radially beyond an exterior surface of the pipe wall.

Embodiment 8: The apparatus of any prior embodiment, wherein the filtration assembly includes a filtration device having a porous medium fixedly attached to the blank section, the porous medium providing fluid communication between an annular region surrounding the blank section and an interior of the base pipe.

Embodiment 9: The apparatus of any prior embodiment, wherein the porous medium includes a beaded matrix.

Embodiment 10: The apparatus of any prior embodiment, wherein the filtration assembly includes a plurality of filtration devices arrayed along the blank section.

Embodiment 11: The apparatus of any prior embodiment, wherein the filtration device includes a disc configured to be inserted in and secured to a receptacle in a wall of the blank section.

Embodiment 12: The apparatus of any prior embodiment, wherein the filtration assembly includes a beaded matrix attached to the blank section, the beaded matrix providing fluid communication between an annular region surrounding the blank section and an interior of the base pipe.

Embodiment 13: A method of controlling particulates in downhole fluid comprising: deploying a gravel packing apparatus in a borehole in a subterranean region, the gravel packing apparatus including a base pipe defining an interior fluid conduit, the base pipe having a production section configured to provide fluid communication between an exterior of the base pipe and an interior of the base pipe, the base pipe having a blank section, the gravel packing apparatus including a screen surrounding the production section, the screen in fluid communication with an annular region of a borehole and configured to prevent particulate matter from passing therethrough; injecting a gravel slurry into the borehole and advancing the gravel slurry to an annular region of the borehole surrounding the gravel packing apparatus; and dehydrating the gravel slurry to form a gravel pack, wherein the dehydrating includes removing fluid from the gravel slurry through the screen, and flowing fluid from a portion of the gravel slurry surrounding the blank section via a filtration assembly disposed proximate to the blank section, the filtration assembly including a fluid passage extending between an exterior of the blank section and an interior of the blank section.

Embodiment 14: The method of any prior embodiment, wherein the blank section extends to an end of the base pipe, the end of the base pipe including a connection arrangement configured to connect the gravel packing apparatus to another downhole component.

Embodiment 15: The method of any prior embodiment, wherein the blank section of the base pipe has a pipe wall, and the filtration device extends through the pipe wall and is configured so that the filtration device does not extend radially beyond an exterior surface of the pipe wall.

Embodiment 16: The method of any prior embodiment, wherein the filtration assembly includes a filtration device having a porous medium fixedly attached to the blank section, the porous medium providing fluid communication between an annular region surrounding the blank section and an interior of the base pipe.

Embodiment 17: The method of any prior embodiment, wherein the porous medium includes a beaded matrix.

Embodiment 18: The method of any prior embodiment, wherein the filtration assembly includes a plurality of filtration devices arrayed along the blank section.

Embodiment 19: The method of any prior embodiment, wherein the filtration device includes a disc configured to be inserted in and secured to a receptacle in a wall of the blank section.

Embodiment 20: The method of any prior embodiment, wherein the filtration assembly includes a beaded matrix attached to the blank section, the beaded matrix providing fluid communication between an annular region surrounding the blank section and an interior of the base pipe.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A gravel packing apparatus comprising:

a base pipe defining an interior fluid conduit, the base pipe having a production section configured to provide fluid communication between an exterior of the base pipe and an interior of the base pipe, the base pipe having a blank section, the blank section configured to be handled when deploying the base pipe and the production section from a surface location into a borehole;

a screen surrounding the production section, the screen in fluid communication with an annular region of the borehole and configured to prevent particulate matter from passing therethrough; and a filtration assembly disposed proximate to the blank section, the filtration assembly including a fluid passage extending through a wall of the blank section between an exterior of the blank section and an interior of the blank section, the filtration assembly including a filtration device having a porous medium providing fluid communication between the fluid passage and an annular region surrounding the blank section, the filtration device recessed from an exterior surface of the blank section.

2. The apparatus of claim 1, wherein the blank section extends to an end of the base pipe, the end of the base pipe including a connection arrangement configured to connect the gravel packing apparatus to another downhole component.

3. The apparatus of claim 1, wherein the gravel packing apparatus is configured to be deployed in a borehole and form part of a gravel pack, the gravel pack formed by injecting a gravel slurry into the borehole and advancing the gravel slurry to the annular region of the borehole surrounding the gravel packing apparatus, and dehydrating the gravel slurry by removing fluid from the gravel slurry and flowing the fluid through the screen and the production section to an interior of the base pipe.

4. The apparatus of claim 3, wherein the filtration assembly is configured to dehydrate a portion of the gravel slurry surrounding the blank section.

5. The apparatus of claim 1, further comprising at least one fluid conduit extending axially along the base pipe, the at least one fluid conduit configured to transport a gravel slurry.

6. The apparatus of claim 5, wherein the at least one fluid conduit is configured to provide a fluid path for the gravel slurry in response to a restriction in the annular region that impedes a flow of a gravel slurry.

7. The apparatus of claim 1, wherein the blank section of the base pipe has a pipe wall, and the filtration device extends through the pipe wall and is configured so that the filtration device does not extend radially beyond an exterior surface of the pipe wall.

8. The apparatus of claim 1, wherein the porous medium includes a beaded matrix.

9. The apparatus of claim 1, wherein the filtration assembly includes a plurality of filtration devices arrayed along the blank section.

10. The apparatus of claim 1, wherein the filtration device includes a disc configured to be inserted in and secured to a receptacle in a wall of the blank section.

11. The apparatus of claim 1, wherein the filtration assembly includes a beaded matrix attached to the blank section, the beaded matrix providing fluid communication between the annular region surrounding the blank section and an interior of the base pipe.

12. A method of controlling particulates in downhole fluid comprising:

deploying a gravel packing apparatus in a borehole in a subterranean region, the gravel packing apparatus including a base pipe defining an interior fluid conduit, the base pipe having a production section configured to provide fluid communication between an exterior of the base pipe and an interior of the base pipe, the base pipe having a blank section, the blank section configured to be handled when deploying the base pipe and the production section from a surface location into the borehole, the gravel packing apparatus including a screen surrounding the production section, the screen in fluid communication with an annular region of the borehole and configured to prevent particulate matter from passing therethrough;

injecting a gravel slurry into the borehole and advancing the gravel slurry to an annular region of the borehole surrounding the gravel packing apparatus; and dehydrating the gravel slurry to form a gravel pack, wherein the dehydrating includes removing fluid from the gravel slurry through the screen, and flowing fluid from a portion of the gravel slurry surrounding the blank section via a filtration assembly disposed proximate to the blank section, the filtration assembly including a fluid passage extending through a wall of the blank section between an exterior of the blank section and an interior of the blank section, the filtration assembly including a filtration device having a porous medium providing fluid communication between the fluid passage and an annular region surrounding the blank section, the filtration device recessed from an exterior surface of the blank section.

13. The method of claim 12, wherein the blank section extends to an end of the base pipe, the end of the base pipe including a connection arrangement configured to connect the gravel packing apparatus to another downhole component.

14. The method of claim 12, wherein the blank section of the base pipe has a pipe wall, and the filtration device extends through the pipe wall and is configured so that the filtration device does not extend radially beyond an exterior surface of the pipe wall.

15. The method of claim 12, wherein the porous medium includes a beaded matrix.

16. The method of claim 12, wherein the filtration assembly includes a plurality of filtration devices arrayed along the blank section.

17. The method of claim 12, wherein the filtration device includes a disc configured to be inserted in and secured to a receptacle in a wall of the blank section.

18. The method of claim 12, wherein the filtration assembly includes a beaded matrix attached to the blank section, the beaded matrix providing fluid communication between the annular region surrounding the blank section and an interior of the base pipe.

* * * * *